US008984915B2

(12) United States Patent
Heo et al.

(10) Patent No.: US 8,984,915 B2
(45) Date of Patent: Mar. 24, 2015

(54) LAUNDRY WASHING APPARATUS

(75) Inventors: Nam Yeong Heo, Changwon-si (KR); In Hee Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 887 days.

(21) Appl. No.: 13/147,561

(22) PCT Filed: Feb. 2, 2010

(86) PCT No.: PCT/KR2010/000632

§ 371 (c)(1),
(2), (4) Date: Aug. 2, 2011

(87) PCT Pub. No.: WO2010/087683

PCT Pub. Date: Aug. 5, 2010

(65) Prior Publication Data

US 2011/0285262 A1 Nov. 24, 2011

(30) Foreign Application Priority Data

Feb. 2, 2009 (KR) ..... 10-2009-0007924

(51) Int. Cl.

| | |
|---|---|
| ***D06F 39/14*** | (2006.01) |
| ***G07F 17/20*** | (2006.01) |
| ***D06F 37/20*** | (2006.01) |
| ***D06F 39/12*** | (2006.01) |

(52) U.S. Cl.

CPC ..... *D06F 39/14* (2013.01); *D06F 37/20* (2013.01); *D06F 39/12* (2013.01); *G07F 17/20* (2013.01)

USPC ..... 68/12.26; 68/3 R

(58) Field of Classification Search

CPC ..... D06F 39/12; D06F 39/14; G07F 17/20

USPC ..... 68/12.26, 3 R

See application file for complete search history.

(56) References Cited

U.S. PATENT DOCUMENTS

| | | | | |
|---|---|---|---|---|
| 3,922,048 | A | 11/1975 | Christianson et al. | |
| 4,646,446 | A * | 3/1987 | Bubley | 34/278 |
| 5,263,344 | A | 11/1993 | Madison | |
| 2011/0241508 | A1 * | 10/2011 | Heo | 312/237 |

FOREIGN PATENT DOCUMENTS

| | | | |
|---|---|---|---|
| DE | 198 43 228 | C1 | 1/2000 |
| KR | 20-0399775 | Y1 | 10/2005 |
| KR | 20-0399776 | Y1 | 10/2005 |
| KR | 10-2007-0001608 | A | 1/2007 |
| KR | 10-2007-0001610 | A | 1/2007 |
| KR | 10-2008-0076513 | A | 8/2008 |

OTHER PUBLICATIONS

Machine translation of KR 20-0399775, no date.*

* cited by examiner

*Primary Examiner* — Joseph L Perrin

(74) *Attorney, Agent, or Firm* — Birch, Stewart, Kolasch & Birch, LLP

(57) ABSTRACT

The present invention relates to a laundry washing apparatus and particularly to a laundry washing apparatus comprising a base that forms a lower face, front/rear plates that form front and rear directions, side plates that form both sides, and a top plate that forms an upper part, wherein the top plate is further furnished with a locking device that controls the locking state of the top plate by means of an external key insertion operation, so that theft of a payment apparatus installed on the top plate can be effectively prevented.

7 Claims, 4 Drawing Sheets

LAUNDRY WASHING APPARATUS

TECHNICAL FIELD

The present invention relates to laundry machines, and more particularly, to a laundry machine in which locking of a cabinet which forms an exterior of the laundry machine is improved.

BACKGROUND ART

In general, the laundry machine washes laundry through steps of washing, rinsing, spinning to remove contaminants from the laundry held in a washing tub by using action of washing water supplied to a tub and detergent.

In the steps of washing of the laundry machine, an amount of the laundry introduced to the washing tub is measured, amounts of the washing water and the detergent and a total washing time period are set according to the amount of laundry measured thus, the washing tub is rotated according to the total washing time period for performing a washing course for removing dirt from the laundry by friction of the washing water and the laundry caused by rotation of the washing tub.

Once the washing course is finished, a rinsing course is preformed, in which contaminated washing water is drained form the tub, new washing water is supplied to the tub, the laundry is rinsed for a preset number of time. And, once the rinsing course is finished, a spinning course is performed, in which the washing water is drained from the tub, and the washing tub is rotated at a high speed, to remove water from the laundry by centrifugal force.

In a case of a commercial laundry machine, the laundry machine has a payment unit mounted to a top or a side thereof. In general, the payment unit is mounted to a cabinet which forms an exterior of the laundry machine. The user can use the laundry machine after the user pays a certain amount of money by means of the payment unit.

In the meantime, the payment unit in the commercial laundry machine is provided to use paper money or coins for user's convenience. The paper money and coins introduced to the payment unit is held in a storage box in the payment unit (or the laundry machine.

However, in a case of the commercial laundry machine, the storage box that holds the paper money or the coins can be stolen. That is, the payment unit can be removed from the cabinet of the laundry machine forcibly, and taken away from the laundry machine.

Consequently, a method for solving this problem has been suggested, in which securing of the payment unit to the cabinet is made firmly for preventing the payment unit from being stolen. However, even if the securing of the payment unit to the cabinet is made firmly, if securing of the cabinet itself is poor, a part of the cabinet is removed together with the payment unit for taking away the payment unit.

DISCLOSURE

Technical Problem

To solve the problems, an object of the present invention is to provide a laundry machine in which a securing structure of a cabinet which forms an exterior of the laundry machine is improved for preventing a payment unit secured to the cabinet from being stolen.

Technical Solution

To achieve these objects and other advantages and in accordance with the purpose of the invention, as embodied and broadly described herein, a laundry machine includes a base which forms a bottom of the laundry machine, front/rear plates which form a front and a rear of the laundry machine 100 respectively, side plates which form opposite sides of the laundry machine, and a top plate which forms a top of the laundry machine, wherein the top plate includes a locking device for controlling a locking state of the top plate by an external key placing-in action.

Preferably, the locking device is mounted to the front plate, the rear plate, or the side plate for controlling the locking state of the front plate.

Preferably, the locking device is mounted to one side direction of the top plate, and a hinge is mounted to the other side direction of the top plate.

Preferably, the top plate has an edge bent downward in a '⊂' shape in section, to form a first coupling surface and one of the front plate, the rear plate or the side plates has a second coupling surface formed on a top side, which is a bent extension therefrom to have a '⌈' shape to be in contact with the first coupling surface.

Preferably, the first coupling surface and the second coupling surface respectively have a first locking slot and a second locking slot aligned to each other so that the locking device is placed in the first locking slot and the second locking slot at a time for maintaining a locked state of the top plate.

Preferably, the locking device includes a key box mounted to one of the front plate, the rear plate or the side plates, and a locking portion for placing both in the first locking slot and the second locking slot.

Preferably, the locking portion includes a latching piece of a hook shape to be projected toward a locking rotation direction at the time of locking rotation at the key box.

Preferably, the first coupling surface has a plurality of the fixing holes and the second coupling surface has a plurality of fixing pieces for placing in the fixing holes, respectively.

The laundry machine further includes a payment unit mounted to the top plate for settling an amount of money for using the laundry machine.

In another aspect of the present invention, a laundry machine includes a cabinet having an exterior with one opened side, a top plate secured to the cabinet at the opened side so as to be opened/closed, a payment unit secured to one side of the top plate for a user to pay an amount of money for using the laundry machine, a locking device mounted adjacent to coupling surfaces of the top plate and the cabinet for enabling locking of the cabinet and the top plate at a time.

Preferably, the top plate has one side having a 'c' section to form a first coupling surface having a first locking slot formed therein for placing the locking device therein when the top plate is coupled to the cabinet, bringing the top plate into contact with the cabinet.

Preferably, the opened side of the cabinet has a 'r' shaped section to form a second coupling surface having a second locking slot formed therein for placing the locking device therein when the top plate is coupled to the cabinet, bringing the top plate into contact with the cabinet.

Preferably, the locking device includes a key box mounted to an inside of a front of the cabinet, a rotation shaft extended and rotatably projected from the key box, and a locking portion placed on the rotation shaft for locking the top plate to the cabinet.

Preferably wherein the locking portion includes a locking portion body, a slot formed in one end of the locking portion body for coupling to the rotation shaft for rotating the locking portion body together with the rotation shaft, and a latching piece formed at the other end of the locking portion body for placing in the first locking slot and the second locking slot to lock an upper side of the first locking slot like a hook.

Preferably, the locking device is arranged to a front of the cabinet adjacent to the payment unit.

Advantageous Effects

The present invention has following advantageous effects.

The laundry machine of the present invention can prevent the payment unit from being stolen by modifying a coupling structure of the cabinet to which the payment unit is mounted of a commercially used laundry machine.

DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements are defined taking functions thereof into account. Therefore, it is required to understand that the names do not limit the elements technically. Moreover, the names of the elements may be called differently in this field of art.

The present invention will be described, taking a front loading type laundry machine as an example. However, the present invention is applicable to other types of the laundry machine (for an example, a top loading type laundry machine).

Figure 1:
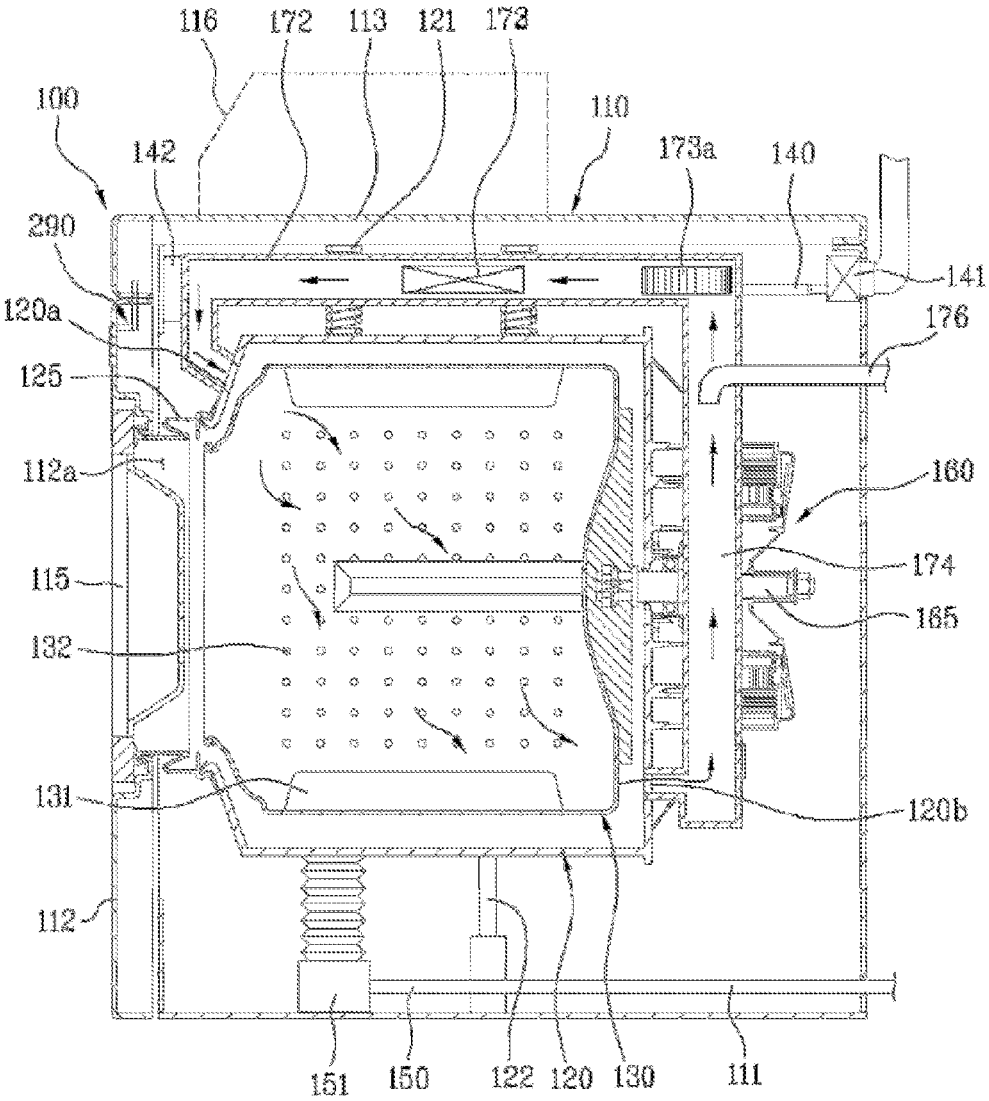
FIG. 1 illustrates a longitudinal section of a laundry machine in accordance with a preferred embodiment of the present invention, schematically.

The present invention will be described with reference to the attached drawings. FIG. 1 illustrates a longitudinal section of a laundry machine in accordance with a preferred embodiment of the present invention, schematically.

Referring to FIG. 1, the laundry machine 100 includes a cabinet 110 which forms an exterior of the laundry machine 100, a tub 120 in the cabinet 110 for holding washing water, a drum 130 rotatably mounted in the tub 120, and a motor 160 for driving the drum 130.

The cabinet 110 includes a base 111 which forms a bottom of the laundry machine 100, side plates (not shown) which form opposite sides of the laundry machine, a front plate 112 which forms a front of the laundry machine 100, a rear plate (not shown) which forms a rear side of the laundry machine 100, and a top plate 113 which forms a top of the laundry machine 100.

The front plate 112 has a laundry opening 112*a* for introducing the laundry therethrough. The cabinet 110 has a door 115 rotatably mounted to one side of the laundry opening 112*a*. The laundry opening 112*a* is opened/closed by the door 115.

The tub 120 has a top side secured to hanging springs 121 which are secured to a top side of the cabinet 110 and a bottom side supported on dampers 122 for attenuating vibration from the laundry machine 100 when the drum 130 rotates at a high speed.

Along with this, the drum 130 has lifts 131 on an inside circumference for lifting the laundry introduced to the drum 130 to a predetermined height when the drum 130 rotates. The drum 130 has a plurality of pass through holes 132 in a circumferential surface for escape of washing water from the drum 130 in washing steps, such as spinning.

In the meantime, on an upper side of the tub 120, there are a water supply hose 140 for supplying water to the tub 120 from an external water source, a water supply valve 141 on the water supply hose 140 for controlling in/out of the water, and a detergent supply unit 142 for holding detergent to supply the detergent together with the water being supplied to the tub 120 through the water supply hose 140.

On a lower side of the tub 120, there are a drain hose 150 and a drain pump 151 for draining the washing water used in washing and rinsing to an outside of the laundry machine 100. There is a motor 160 mounted in rear of the tub 120 coupled to the drum 130 with the rotation shaft 165 for rotating the drum 130.

In the meantime, the laundry machine 100 may have a circulating duct 170 for circulating air for a drying course. That is, the circulating duct 170 configured such that the circulating duct 170 draws air from the tub 120, heats the air, and introduces the air to the tub 120, again.

The circulating duct 170 has a drying duct 172 and a condensing duct 174. Mounted in the drying duct 172, there are a heater 173 and a fan 173*a* for blowing hot air to the tub 120.

The drying duct 172 and the condensing duct 174 are in communication with each other as well as with the drum 130, and the tub 120 has an air inlet 120*a* for introduction of the hot air thereto through the drying duct 172 and an air outlet 120*b* for discharging the air therefrom to the condensing duct 174.

In the meantime, the cabinet 110 of the laundry machine 100 of the present invention has a locking device 290 for locking respective plates 112 and 113 of the cabinet 110. For convenience's sake, the laundry machine 100 of the present invention will be described, taking the locking device 290 formed between the front plate 112 and the top plate 113 of the cabinet 110, as an example. However, this example does not limit a mounting position of the locking device 290, but the locking device 290 can be mounted wherever one pair of plates are adjacent to each other.

Figure 2:
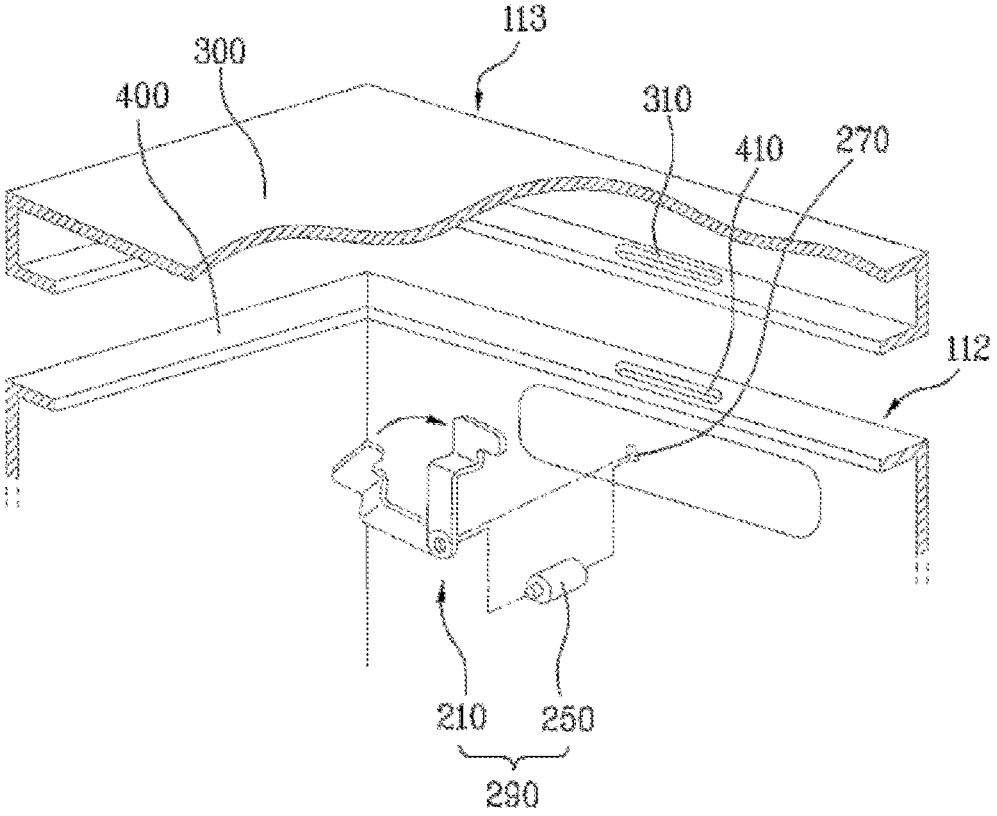
FIG. 2 illustrates an exploded perspective view of a secured state of a payment unit in a laundry machine in accordance with a preferred embodiment of the present invention.
Figure 3:
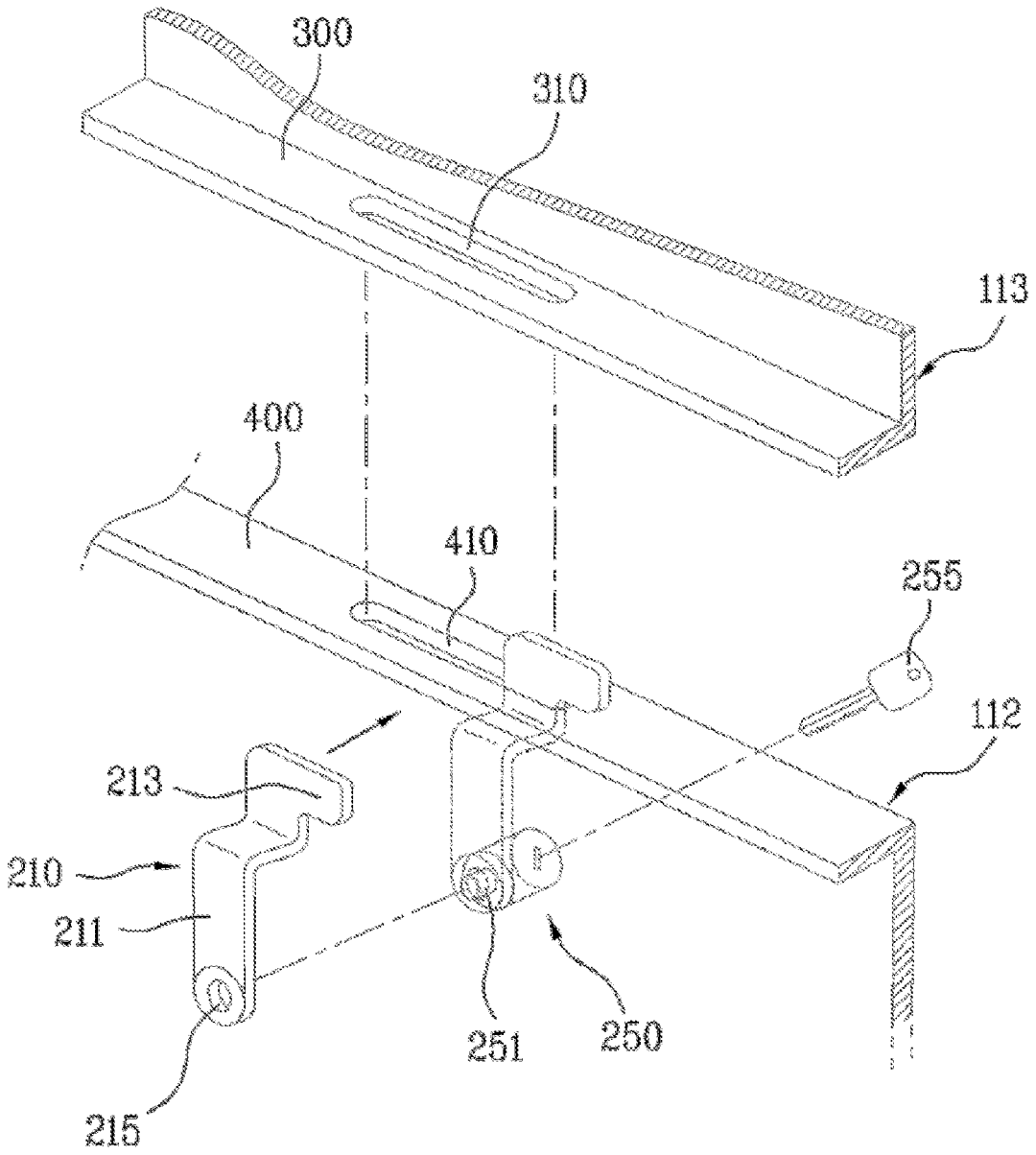
FIG. 3 illustrates an enlarged perspective view of a payment unit in a laundry machine in accordance with a preferred embodiment of the present invention.

FIG. 2 illustrates an exploded perspective view of a secured state of a payment unit in a laundry machine in accordance with a preferred embodiment of the present invention, and FIG. 3 illustrates an enlarged perspective view of a payment unit in a laundry machine in accordance with a preferred embodiment of the present invention.

Referring to FIG. 2, on an inside of the cabinet 110 of the laundry machine 100, there is the locking device 290 for securing the top plate 113 of the cabinet 110, additionally. The locking device 290 can be mounted to the front plate 112 which forms the front of the cabinet 110. However, the locking device 290 may be mounted to the side plate (not shown) for locking the top plate 113.

It is preferable that the locking device 290 is arranged to the top plate 113 or adjacent to a payment unit 116 mounted to the cabinet 110. An object of the present invention is for preventing the payment unit 116 from being stolen. Therefore, for security of the top plate 113 or an inside of the cabinet 110 to which the payment unit 116 is secured, the locking device 290 is mounted adjacent to the payment unit 116.

A structure of the top plate 113 will be described. The top plate 113 is a rectangular plate which forms a top surface of the laundry machine 100. The top plate 113 has an edge bent downward in a 'c' shape in section, substantially. The downward bent edge of the top plate 113 forms a first coupling surface 300 which is in surface to surface contact with top surfaces of the front plate 112 and the side plates. Therefore, the first coupling surface 300 is form along an underside circumference of the top plate 113.

The first coupling surface 300 has a first locking slot 310 for placing the locking device 290 therein. The first locking slot 310 can be formed in the front plate 112 to which the locking device 290 is mounted.

The front plate 112 has a second coupling surface 400 formed on a top side in conformity with the first coupling surface 300 of the top plate 113. The second coupling surface 400 is a bent extension from the front plate to have a 'r' shape. The second coupling surface 400 has a second locking slot 410 formed at a position matched to the first locking slot 310. That is, if first coupling surface 300 is seated on the second coupling surface 400, the first locking slot 310 is in communication with the second locking slot 410. The locking device 290 is fastened to the first and second locking slots 310 and 410 formed to be in communication with each other thus.

The locking device 290 is rotatably mounted to an inside of the front plate 112. As being rotated, the locking device 290 is placed in the first and second locking slots 310 and 410 to turn the top plate 113 into a locked state.

The locking device 290 includes a key box 250 for being locked/unlocked as a key 255 is placed therein, and a locking portion 210 coupled to the key box 250 for being rotated as the key 255 is placed in the key box 250 so as to be placed in the first and second locking slots 310 and 410.

The key box 250 has a rotation shaft 251 formed at one side for being rotated as the key 255 placed in the key box 250 is rotated.

The locking portion 210 has one end with a hole 215 for coupling to the rotation shaft 251, and the other end with a latching piece 213 for placing in the first locking slot 310 and the second locking slot 410. The locking portion 210 can be bent taking a space where the key box 250 is arranged into account. The latching piece 213 is projected like a hook for being placed in the first locking slot 310 and the second locking slot 410 when the latching piece 213 is rotated to apply a pressure to an upper side of the first locking slot to prevent the top plate from moving away.

Figure 4:
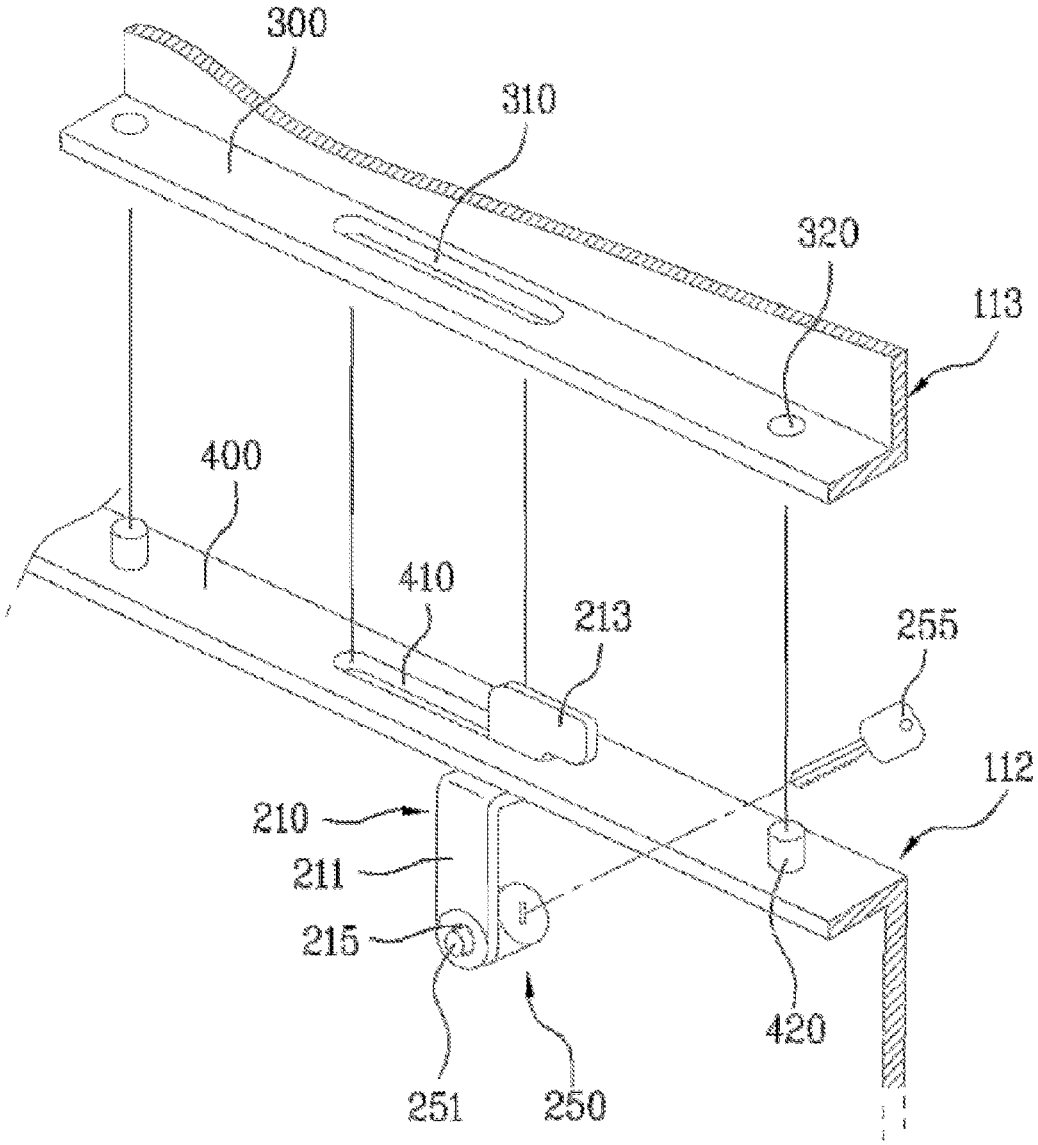
FIG. 4 illustrates a perspective view of a payment unit in a laundry machine in accordance with a preferred embodiment of the present invention.

FIG. 4 illustrates a perspective view of a payment unit in a laundry machine in accordance with another preferred embodiment of the present invention. In the another preferred embodiment, a securing state of the front plate 112 (or the side plate) to the top plate 113 is modified additionally. Therefore, detailed description of parts identical to the foregoing embodiment will be omitted.

Referring to FIG. 4, on both sides of the first locking slot 310 formed in the first coupling surface 300, there are fixing holes 320 are formed. And, on both sides of the second locking slot 410 formed in the second coupling surface 400, there are fixing pieces 420 are projected from the second coupling surface 400.

If the top plate 113 is placed on the front plate 112 (or the side plate), the first locking slot 310 and the second locking slot 410 are aligned so as to be in communication with each other and the fixing pieces 420 on the second coupling surface 400 are placed in the fixing holes 320 in the first coupling surface 300 and coupled thereto, respectively.

The coupling of the fixing pieces 420 to the fixing holes 320 respectively supplements locking of the locking device 290 which is rotated and latches the first locking slot 310 and the second locking slot 410. That is, the respective coupling of the fixing pieces 420 to the fixing holes 320 prevents the locking device 290 which is rotated and latches the first locking slot 310 and the second locking slot 410 from being unlocked by external force applied to the top plate 113 in a lateral direction.

It is preferable that the fixing pieces 420 and the fixing holes 320 are formed on opposite sides of the first and second locking slots 310 and 410, for preventing the latching piece 213 of the locking portion 210 from moving away from the first and second locking slots 310 and 410 when external force is applied in a direction the same with the locking direction of the locking portion 210, thereby causing the top plate 113 from separating from the front plate 112. According to this, the respective coupling of the fixing pieces 420 to the fixing holes 320 enables to sustain a latching state of the locking portion 210 of the locking device 290 at the first and second locking slots 310 and 410 by withstanding the external force applied to a side and a front of the top plate 113.

It is apparent that a plurality of the fixing holes 320 and the fixing pieces 420 can be provided to the first and second coupling surfaces 300 and 400 respectively, and a plurality of the locking devices 290 can also be provided according to directions of opening of the top plate 113 and mounting positions of the laundry machine.

In the meantime, the top plate 113 may be fastened with hinges (not shown) mounted to one side thereof. That is, if one side that is opened/closed by the locking device 290 is opened, the other side is rotated round the hinge to open/close the top plate 113.

The operation of the locking device of the present invention will be described, taking a commercial laundry machine as an example.

The laundry machine 100 starts and ends a washing process as the user places an amount of coins (or paper money) in the payment unit 116 to finish required payment according to a purpose of use. Accordingly, the coins placed in the payment unit 116 are held in the payment unit 116 or the laundry machine 100.

Therefore, if a certain time period is passed, in order to collect the coins or paper money, a manager may open the locking device 290 and collect the coins and the paper money held therein.

To do this, if the manager places a key in the key box 250 from an outside of the front plate 112 and turns the key, the rotation shaft 251 of the key box 250 is rotated to turn the locking portion 210, thereby releasing a locking state of the top plate 113.

In the meantime, if the manager collects the coins from the payment unit 116 and closes the top plate 113, the first coupling surface 300 of the top plate 113 is placed on the second coupling surface 400 of the front plate 112, aligning the first locking slot 310 with the second locking slot 410. At the same time with this, the fixing pieces 420 on the second coupling surface 400 are placed in the fixing holes 320 in the first coupling surface 300 respectively, thereby coupling the top plate 113 to the front plate 112.

Then, if the manager places the key in the key box 250 from an outside of the front plate 112 and turns the key, the rotation shaft 251 projected from the key box 250 rotates. According to this, the locking portion 210 coupled to the rotation shaft 251 rotates until the locking portion 210 is placed in the first locking slot 310 and the second locking slot 410 and locks the top plate 113. That is, the locking portion 210 passes through the first locking slot 310 and the second locking slot 410 and presses down the first coupling surface to the second coupling surface, thereby locking the top plate 113.

Eventually, owing to the top plate locking device, separation of the top plate from the front plate is limited at first, and owing to the fixing pieces and the fixing holes, the separation is limited, additionally.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine comprising:

a base which forms a bottom of the laundry machine;

front/rear plates which form a front and a rear of the laundry machine, respectively;

side plates which form opposite sides of the laundry machine; and a top plate which forms a top of the laundry machine, wherein the top plate includes a locking device for controlling a locking state of the top plate by an external key placing-in action, wherein the top plate has an edge bent downward in a '⊂' shape in section, to form a first coupling surface and one of the front plate, the rear plate or the side plates has a second coupling surface formed on a top side, which is a bent extension therefrom to have a '⌈' shape to be in contact with the first coupling surface, and wherein the first coupling surface and the second coupling surface respectively have a first locking slot and a second locking slot aligned to each other so that the locking device is placed in the first locking slot and the second locking slot at a time for maintaining a locked state of the top plate.

2. The laundry machine as claimed in claim 1, wherein the locking device is mounted to the front plate, the rear plate, or the side plates for controlling the locking state of the top plate.

3. The laundry machine as claimed in claim 1, wherein the locking device is mounted at any one of a front side, a back side, a left side and a right side of the top plate, and a hinge rotatably coupled to any one of the side plates is further mounted at any one of the sides of the top plate other than the side of the top plate, at which the locking device is mounted.

4. The laundry machine as claimed in claim 1, wherein the locking device includes:

a key box mounted to one of the front plate, the rear plate or the side plates; and a locking portion for placing both in the first locking slot and the second locking slot.

5. The laundry machine as claimed in claim 4, wherein the locking portion includes a latching piece of a hook shape to be projected toward a locking rotation direction at the time of locking rotation at the key box.

6. The laundry machine as claimed in claim 1, wherein the first coupling surface has a plurality of the fixing holes and the second coupling surface has a plurality of fixing pieces for placing in the fixing holes, respectively.

7. The laundry machine as claimed in claim 1, further comprising a payment unit mounted to the top plate for settling an amount of money for using the laundry machine.

* * * * *